US006371744B1

(12) United States Patent
Mito et al.

(10) Patent No.: US 6,371,744 B1
(45) Date of Patent: Apr. 16, 2002

(54) DRY SCREW VACUUM PUMP HAVING SPHEROIDAL GRAPHITE CAST IRON ROTORS

(75) Inventors: Masaru Mito; Masashi Yoshimura; Masaaki Takahashi, all of Yamaguchi (JP)

(73) Assignee: Taiko Kikai Industries Co., Ltd. (JP)

( * ) Notice: Subject to any disclaimer, the term of this patent is extended or adjusted under 35 U.S.C. 154(b) by 0 days.

(21) Appl. No.: 09/646,996

(22) PCT Filed: Jun. 26, 1998

(86) PCT No.: PCT/JP98/02864

§ 371 Date: Sep. 22, 2000

§ 102(e) Date: Sep. 22, 2000

(87) PCT Pub. No.: WO99/49220

PCT Pub. Date: Sep. 30, 1999

(30) Foreign Application Priority Data

Mar. 23, 1998 (JP) ..... 10-074228
Apr. 6, 1998 (JP) ..... 10-093221
Apr. 19, 1998 (JP) ..... 10-093220

(51) Int. Cl.[7] ..... F04C 18/16
(52) U.S. Cl. ..... 418/179; 418/201.1; 418/201.3
(58) Field of Search ..... 418/179, 201.1, 418/201.3, 206.2, 206.8

(56) References Cited

U.S. PATENT DOCUMENTS 5,154,595 A * 10/1992 Takeda ..... 418/201.1
5,697,772 A * 12/1997 Kawamura et al. ..... 418/201.3

FOREIGN PATENT DOCUMENTS

| | | | | |
|---|---|---|---|---|
| DE | 3344882 | * | 6/1984 | ..... 418/179 |
| JP | A 60-142081 | | 7/1985 | |
| JP | A 63-272986 | | 11/1988 | |
| JP | U 4-69689 | | 6/1992 | |
| JP | A 4-203386 | | 7/1993 | |

* cited by examiner

*Primary Examiner*—John J. Vrablik
(74) *Attorney, Agent, or Firm*—Baker & Daniels

(57) ABSTRACT

A dry vacuum pump that includes a casting having an inner cylinder communicating with an inlet and an outlet of the pump, shafts supported by the casting, spiral toothed parts formed on the shaft a plurality of screw rotors each of which includes the shaft and the spiral toothed parts received in the inner cylinder intermeshing with each other. Timing gears each of which are attached to the respective shafts of the screw rotors that intermesh with each other. Locking mechanisms for fixing the timing gears to the shaft. Both of the shaft and the toothed part are made of spheroidal graphite cast iron containing 20 to 30 wt % of nickel are cast integrally.

2 Claims, 12 Drawing Sheets

DRY SCREW VACUUM PUMP HAVING SPHEROIDAL GRAPHITE CAST IRON ROTORS

TECHNICAL FIELD

The present invention relates to a screw rotor-type dry vacuum pump and, more specifically, to a vacuum pump having a corrosion-resistance against gas generated in an apparatus for producing semiconductors, a dry vacuum pump in which a corrosion-resistant nickel alloy is employed as a material of a casing and a screw rotor that come in contact with a corrosive fluid, and a dry vacuum pump in which reaction products of process gas in an apparatus for producing semiconductors are prevented from building up in a path of a blast pipe of the dry vacuum pump.

BACKGROUND ART

A structure of a screw rotor-type dry vacuum pump will be explained with reference to its transverse sectional view shown in FIG. 1. A pump casing consists of: a main casing 1; an inlet-side case 2 attached to a right end face of the main casing 1; an outlet-side case 3 attached to a left end face of the main casing 1; and a gear case 4 attached to a left end face of the outlet-side case 3. A motor 5 is attached to the gear case 4.

In the main casing 1, there is provided an inner cylinder 1*a* penetrating through the main casing 1 axially, then an inlet 6 provided in the main casing 1 communicates with the right side of the inner cylinder 1*a* and then, the left side of the inner cylinder 1*a* communicates with an outlet 7 provided in the outlet-side case 3. An abbreviation numeral 8 denotes a chamber of cooling, water.

Two through holes 9 are formed in the inlet-side case 2 and a bearing box 10 containing a bearing 11 therein is attached to each through hole 9. Two through holes 12 are formed in the outlet-side case 3 and a bearing box 13 containing a bearing 14 therein is attached to each through hole 12.

Each of two screw rotors 15 consists of: spiral toothlike parts 15*a,* a cross section of each of which is formed by a Quimby curve, a circular arc and a quasi-Archimedean spiral curve; and a shaft 15*b* formed at both sides of each toothlike part 15*a.* The toothlike parts 15*a* are received in the inner cylinder 1*a* intermeshing with each other and each shaft 15*b* is supported by the bearing 11 or bearing 14.

As to the drive-side screw rotor 15 shown at the lower side in FIG. 1 out of the two screw rotors 15, a timing gear 16 is inserted into a left end of the shaft 15*b,* then fixed by a locking mechanism 17, while the left end of the shaft 15*b* is connected to an output shaft of the motor 5 through a coupling 18. As to the follower-side screw rotor 15 shown at the upper side in FIG. 1 out of the two screw rotors 15, a timing gear 19 that engages with the timing gear 16 is inserted into a left end of the shaft 15*b,* then fixed by the locking mechanism 17.

As shown in FIG. 2, i.e. a partially enlarged view of FIG. 1, the locking mechanism 17 consists of a locking member 20 and a tightening member 21, then a engaging portion 22 for engaging with an outer peripheral surface of the shaft 15*b* is formed at one face of the locking member 20, then a through hole 24 mating with a screw hole 23 formed on an end face of the shaft 15*b* is formed and then a pushing projection 25 is formed outside the engaging portion 22. When the engaging portion 22 of the locking member 20 is inserted into the shaft 15*b,* the locking member 20 is firmly mounted to the shaft 15*b* and the pushing projection 25 abuts on a bottom of a circular groove 26 formed on a side of the timing gear 16.

The tightening member 21 is a bolt. When its end is screwed into the screw hole 23 through the through hole 24 of the locking member 20, the pushing projection 25 pushes the timing gear 16, then the timing gear 16 is pressed between the bearing 14 and the pushing projection 25 and fixed to the shaft 15*b.*

When the motor 5 revolves, the coupling 18 and the drive-side screw rotor 15 revolve, then the revolution of the drive-side screw rotor 15 is transmitted to the follower-side screw rotor 15 through the timing gears 16 and 19, then the two screw rotors 15 revolve in an opposite direction with each other at the same speed so as to transfer the fluid pumped from the inlet 6 to the outlet 7. During this operation, a portion communicated with the inlet 6 is gradually depressed and the main casing 1 is heated, therefore, the main casing 1 is water-cooled.

As to a conventional vacuum pump for use in an apparatus for producing semiconductors, since corrosive gas is pumped up, a resin coating has been generally performed on surfaces of the inner cylinder 1*a* and the screw rotor 15. For example, Tefron coating or Defric (polyimide resin) coating has been performed on an inner surface of the inner cylinder 1*a* and a surface of the screw rotor 15 up to the thickness of 25 to 30 $\mu$m.

Recently however, as to the apparatus for producing semiconductors, micro machining employing plasma has been widely used, then fluoride such as $CF_4$ and $C_2F_6$ have been widely employed as to such apparatus for producing semiconductors in order to clean the apparatus during the manufacturing process. Above all, processes of a plasma-induced chemical vapour deposition and plasma etcher have been frequently employed, in which the fluoride such as $CF_4$ and $C_2F_6$ is fed to remove products generated by nitriding, resulting in generation of activated fluorine system $F^*$ due to an excitation by plasma. Since this $F^*$ is chemically very active, it reacts with $H_2$ gas contained in a process gas to generate HF. This very corrosive HF gas corrodes the resin coating and pulverizes them. Above all, since a vacuum pump employed for the process involving the generation of the products generated by nitriding is heated in order to prevent the products from solidifying and piling up in a casing of the vacuum pump, the reaction of HF production is accelerated, resulting in peeling of the resin coating.

When the resin coating performed on an inner surface of the inner cylinder 1*a* and a surface of the screw rotor 15 up to the thickness of 25 to 30 $\mu$m peels off, a gap having a diameter of 100 to 120 $\mu$m is generated between the screw rotor 15 and the inner cylinder 1*a,* causing a severe deterioration in the performance of the vacuum pump. Since the dry vacuum pump does not use a sealing liquid, the enlargement of the gap brings about a serious defect.

As a measure for solving the problem mentioned above, a corrosion-resistant material might be employed for the screw rotor 15 and the main casing 1 without coating them, however, such a corrosion-resistant material, i.e. SUS (stainless steel) is very hard to be machined. Therefore, SUS is not appropriate for the screw rotor 15 that has a complex shape and requires highly dimensional accuracy. In addition, since SUS has a large coefficient of thermal expansion and a drawback that a seizure is easily occurred, SUS can not be employed as a material for the screw rotor 15 and the main casing 1.

A corrosion-resistant material, in which nickel is added to a spheroidal graphite cast iron having high mechanical strength, has been used to make the screw rotor 15 and the main casing 1. However, since its coefficient of thermal expansion depends on the added amount of nickel and is different from that of the locking mechanism 17 made of mild steel, the locking mechanism 17 becomes loose, causing a slip for the timing gears 16 and 19 and an undesirable contact between screw rotors 15 with each other.

In addition, a bearing fitting portion between the bearing 14 that supports the shaft 15*b* and the bearing box 13 often suffers a creep phenomenon and the bearing 14 often suffers a damage.

The present invention is to solve the above problems by making a spheroidal graphite cast iron containing nickel, which has the same coefficient of thermal expansion with that of the locking mechanism 17 made of mild steel, taking advantage that its coefficient of thermal expansion can be adjusted by varying the added amount of nickel.

As described above, when the output shaft of the motor 5 revolves, the drive-side screw rotor 15 revolves, then the follower-side screw rotor 15 revolves in an opposite direction at the same speed, then the toothlike parts 15*a* revolve intermeshing with each other within the inner cylinder 1*a* in the main casing 1, resulting in that the fluid pumped from the inlet 6 of the main casing 1 is transferred to the outlet 7 of the outlet-side case 3 (see FIG. 8). Here, since a temperature elevation at the outlet side of each toothlike part 15*a* is larger than that at the inlet side thereof, a tapered face of 1/(10L) (L: length of the toothlike part 15*a* ), which decreases in diameter toward the outlet side, is formed with respect to an outer diameter of each toothlike part 15*a,* by taking the thermal expansion of the outlet side into consideration.

Consequently, an outer diameter dimension $D_1$ at the inlet side end of each toothlike part 15*a* is set so that a clearance of 0.2 to 0.25 mm in diameter can be formed against the inner diameter of the inner cylinder 1*a* of the main casing 1, while an outer diameter dimension $D_2$ at the outlet side end of each toothlike part 15*a* is set so that a clearance of 0.3 to 0.35 mm in diameter can be formed against the inner diameter of the inner cylinder 1*a* of the main casing 1.

Although it is effective that the casing and the screw rotor of the dry vacuum pump are made of cast iron containing nickel, the following problems have arisen.

That is, such a material is corrosion-resistant, but has poor machinability. When the length of the inner cylinder 1*a* of the main casing 1 is long and five times as long as the inner diameter of the inner cylinder 1*a,* a deflection arises for a boring bar $B_B$ due to high cutting force upon boring machining of the inner cylinder 1*a,* resulting in a problem that a tool $B_T$ at an end of the boring bar $B_B$ veers away from the right direction (see FIG. 9).

The boring bar $B_B$ can be shortened by machining the inner face of the inner cylinder 1*a* of the main casing 1 from both sides by a length of 0.5 L each. However, in this case, the main casing 1 should be reset by turning it with 180° in angle after a boring of one side by the length of 0.5 L is finished, resulting in that a discrepancy of 0.01 to 0.02 mm between central lines of two inner faces might arise after the machining.

If a small positional discrepancy arises for the central lines, the inner cylinder 1*a* easily comes in contact with an outer peripheral surface of each toothlike part 15*a* of the screw rotor 15 (see FIG. 10), as if an inner diameter of a central portion of the inner surface of the inner cylinder 1*a* becomes small by the same size of this discrepancy.

In addition, cast iron containing nickel has a larger coefficient of thermal expansuon in comparison with that of general cast iron, causing a problem that it deforms due to thermal strain at high temperature.

When a strain of casing arises due to heating of the casing during an operation of the pump, a seizure phenomenon arises at a sliding portion between the casing and the screw rotor. This problem of the seizure phenomenon has been hard to solve.

Various experiments have been tried to solve the above problem. Since the dry vacuum pump is required to have a performance that the degree of vacuum becomes $10^{-3}$ Torr (i.e. order of 1 Pa) within 15 to 20 minutes after the start of operation, a measure that an outer diameter of the screw rotor is set small so as to enlarge the gap between the screw rotor 15 and the inner cylinder 1*a* makes no solution as to the above problem.

Moreover, when the resin coating on the outer face of the screw rotor is performed, the gap enlarges further due to the peeling of the resin coating having thickness of 20 to 30 $\mu$m, causing a severe deterioration in the performance of the pump. Consequently, the method of resin coating needs some contrivance.

Through various experiments, we have studied a thermal expansion and thermal strain of the casing and the screw rotor made of cast iron containing nickel at elevated temperature and then, we have found the desirable gap, in which an amount of thermal expansion, an amount of deformation and the discrepancy of the central lines described above obtained by the present precision of machining are taken into consideration with respect to the portion from the vicinity of the center of the casing up to the outlet side thereof.

On the basis of the above experiments, the present invention is reached under the consideration of allowable dimensional accuracy for machining. The present invention is to provide a dry vacuum pump, in which the casing and the screw rotor are made of cast iron containing nickel that is hard to be machined and a seizure phenomenon never arises when the pump is heated during the operation, by securing the allowable dimensional accuracy determined through the above experiments.

In addition, the following distinct problem has been existed as to the dry vacuum pump.

As shown in FIG. 13, when two screw rotors 15 revolve due to a drive by the motor 5, the fluid pumped from the inlet 6 of the main casing 1 is transferred to the outlet 7 of the main casing 1, then passes through a silencer 31 while passing through an outlet path 30 that is connected to the outlet 7 and then, is discharged to a scrubber 32 from an end of the outlet path 30.

A dry vacuum pump, in which process gases are treated, is called a pump for use in hard process. Here, the process gas is used in an apparatus for producing semiconductors at low pressure and thin film nitrides are formed by the process using CVD (chemical vapour deposition) method and TEOS (tetraethoxysilane) AL Etcher.

A process gas flowing in the casing 1 of a dry vacuum pump A is highly compressed on its way to the outlet 7 (see FIG. 13), then $AlCl_3$ and $NH_3Cl$ generated via the hard process are heated by the heat of compression and discharged from the outlet 7 without solidifying in the casing 1.

However, the process gas pumped at a pressure around $10^0$ to $10^{-3}$ Torr is a diluted gas having $10^{-3}$ to $10^{-6}$ of atmospheric pressure and has small heat capacity even at high temperature. Therefore, the process gas is easily cooled down in the outlet path 30 and the silencer 31, then products in the gas, which solidify due to the cooling, often close the outlet path, causing a tripping or a seizure phenomenon for the motor 5 of the dry vacuum pump A during the production of semiconductors and causing a severe loss in the production of semiconductors.

In order to prevent the products from solidifying, the diluted gas must be prevented from being cooled down in the outlet path 30. Therefore, the diluted gas is prevented from being cooled by attaching a heater 33 or a heat insulating material 34 to the outlet path 30. Instead, the outlet path 30 is frequently disassembled and cleaned to remove the products deposited there.

However, to employ the heater 33 is not appropriate from the viewpoint of preventing fire or saving energy. The cooling of the outlet 30 should be prevented from occurring without using the heater 33 in order to avoid a time-consuming disassembly and cleaning of the outlet 30.

It is therefore an objective of the present invention to solve the above problems and to provide a dry vacuum pump preventing the process gas from cooling down and having a structure, in which the products never deposited in the outlet path 30 of the dry vacuum pump.

DISCLOSURE OF INVENTION

In order to attain the above objective, a first aspect of the present invention is to provide a dry vacuum pump comprising: a casing having an inner cylinder communicating with an inlet and an outlet of the pump; a plurality of screw rotors, each of which comprises a shaft and spiral toothlike parts, received in the inner cylinder with the toothlike parts intermeshing with each other, said shaft is supported by the casing and said spiral toothlike part, a cross section of each of which is formed by a Quimby curve, a circular arc and a quasi-Archimedean spiral curve, is formed integrally on the shaft; timing gears, each of which is attached to the respective shafts of the screw rotors, intermeshing with each other; and locking mechanisms, each of which is for fixing the timing gear to the shaft, wherein the screw rotor is made of spheroidal graphite cast iron containing nickel of 20 to 30% in weight and has substantially the same coefficient of thermal expansion with that of the locking mechanism made of mild steel.

The locking mechanism comprises: a locking member having an engaging portion for engaging to an outer peripheral surface of an end of the shaft and a pushing projection, an end of which abuts on the timing gear; and a tightening member for pressing the pushing projection onto the timing gear.

A second aspect of the present invention is to provide a dry vacuum pump characterized in that a screw rotor comprises: shafts, both ends of which are supported by a casing; and spiral toothlike parts, each of which is formed on an outer surface of the shaft except on both ends of the shaft, a cross section of the spiral toothlike part is formed asymmetrically spiral by a Quimby curve, a circular arc and a quasi-Archimedean spiral curve, and a pair of the screw rotors rotates in an inner cylinder of the casing with the toothlike parts intermeshing with each other so that fluid in the casing is transferred from an inlet side to an outlet side of the pump, in addition, as for the rest, there are two kinds of invention as follows: (1) only the screw rotor is dimensionally adjusted; or (2) both of the screw rotor and the casing are dimensionally adjusted.

The above invention (1) is characterized in that a tapered face of 1/(20L) is formed with respect to the toothlike part so that an outer diameter of the toothlike part is shortened from the center of the toothlike part to the outlet side of the fluid, L being a length of the toothlike part, and a ground finish-surface is formed with respect to the toothlike part so that a diameter of the toothlike part is shortened by 3/100 to 4/100 mm from a position, where is about 10 mm offset toward the inlet side from the center of the toothlike part, to the outlet side.

The above invention (2) is characterized in that a tapered face of 6/(100L) to 7/(100L) is formed with respect to the toothlike part so that an outer diameter of the toothlike part is shortened from the center of the toothlike part to the outlet side of the fluid, L being a length of the toothlike part, and an internal diameter of the inner cylinder is enlarged by 3/100 to 4/100 mm from a position, where is about 10 mm offset toward the inlet side from the center of the inner cylinder, to the outlet side.

A third aspect of the present invention is to provide a screw rotor-type dry vacuum pump characterized in that a pair of right and left handed screw rotors, a cross section of each of which is formed by a Quimby curve, a circular arc and a quasi-Archimedean spiral curve, is received in a casing intermeshing with each other so that a process gas pumped from an inlet of the casing is discharged from an outlet of the casing, wherein the screw rotor has a plurality of leads, a nitrogen-supplying tube communicates with a position near the outlet in the casing, and an outlet path connecting the outlet with a scrubber or a trap is a straight pipe, in which a silencer is removed.

The dry vacuum pump is for use in a hard process, in which the dry vacuum pump pumps up a process gas employed in an apparatus for producing semiconductors.

BEST MODE FOR CARRYING OUT THE INVENTION

In the following, the present invention will be explained with reference to the attached drawings.

Figure 1:
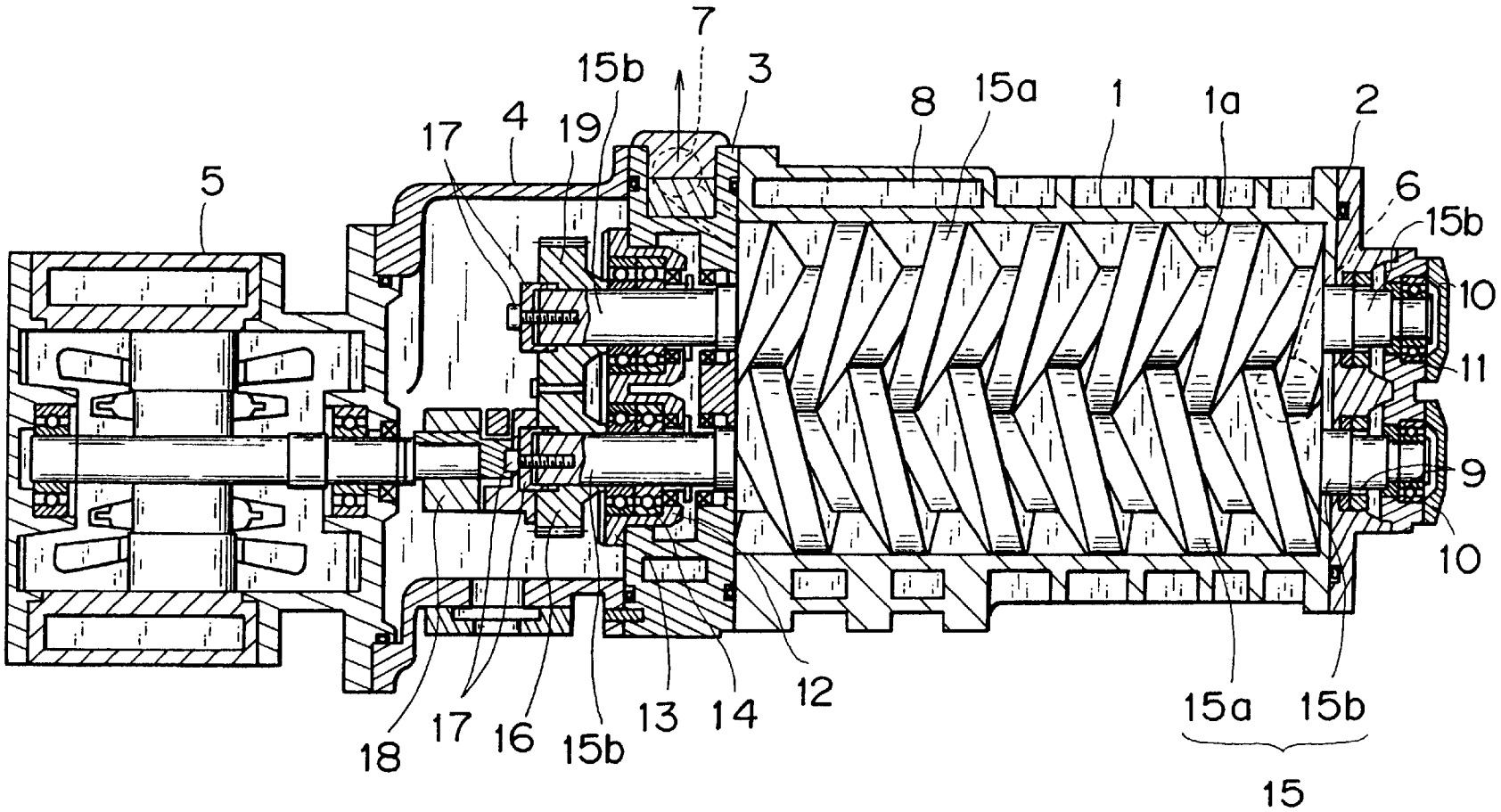
FIG. 1 is a transverse sectional view of a dry vacuum pump.
Figure 2:
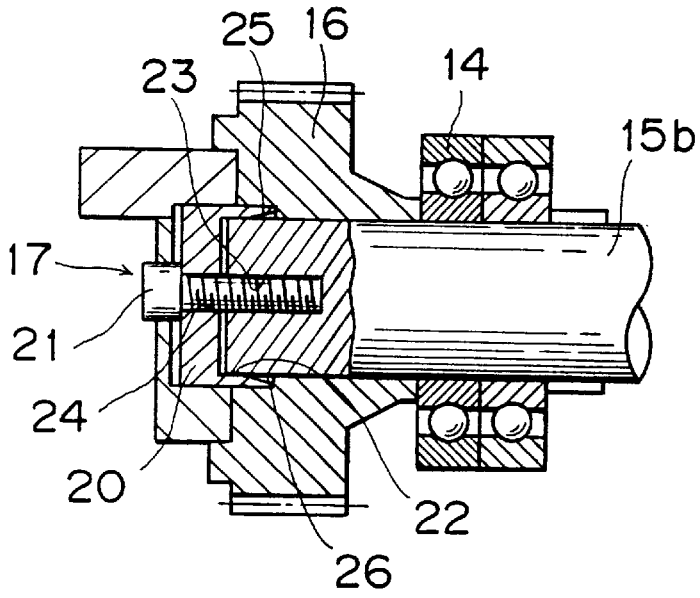
FIG. 2 is a partially enlarged view of FIG. 1.

Since the present invention is applied to a dry vacuum pump shown in FIG. 1, the same abbreviation numerals with those of the vacuum pump shown in FIG. 1 are used and their detailed explanation is omitted.

Figure 3:
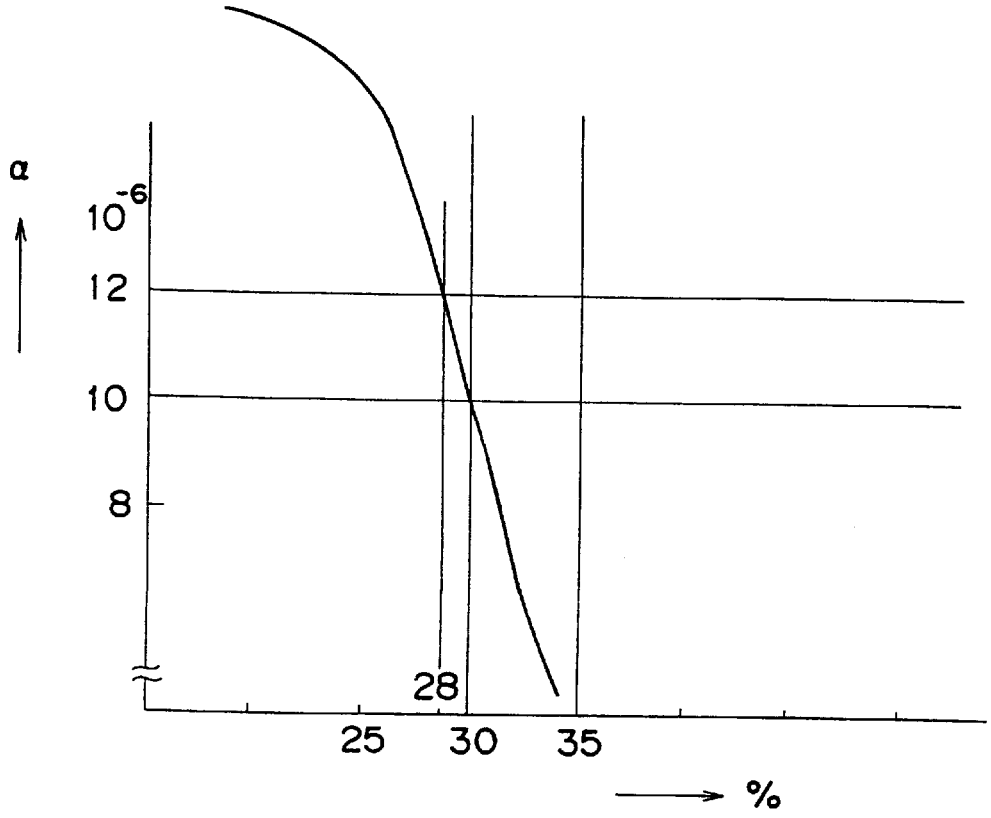
FIG. 3 is a graph illustrating a relationship between Ni content in spheroidal graphite cast iron and coefficient of thermal expansion.

FIG. 3 is a graph illustrating a coefficient of thermal expansion $\alpha$ (longitudinal axis) with respect to nickel content in weight % in spheroidal graphite cast iron (horizontal axis), indicating that the coefficient of thermal expansion a varies significantly depending upon the nickel content.

The locking, mechanism 17 has coefficient of thermal expansion of 10 to $12\times10^{-6}$/°C. similarly to a general mild steel, which is the same with that of spheroidal graphite cast iron containing 28 to 30 wt % of nickel.

A corrosion resistance of the spheroidal graphite cast iron containing 28 to 30 wt % of nickel was found better than that of cast iron as shown in Table 1.

That is, a ratio of corrosion rates of cast iron, spheroidal graphite cast iron and the spheroidal graphite cast iron containing 28 to 30 wt % of nickel with respect to diluted hydrochloric acid was found to be 90.4:12.4:1, respectively, revealing that the spheroidal graphite cast iron containing nickel has excellent corrosion resistance.

TABLE 1

| a kind of liquid | Temp. (° C.) | corrosion rate ($g/m^3hr$) of spheroidal graphite cast iron | corrosion rate ($g/m^3hr$) of cast iron | corrosion rate ($g/m^3hr$) of spheroidal graphite cast iron containing 28–30% Ni | removal of products due to corrosion |
|---|---|---|---|---|---|
| 10% HF | 10–20 | | 4.6 | 0.02 | |
| 1% HCl | 20 | 3.4 | 24.8 | | Yes |
| 1% HCl | 20 | 4.5 | 23.3 | | No |
| 1.8% HCl | RT | | 22.6 | 0.25 | |
| 3.7% HCl | RT | | 25.9 | 0.19 | |
| 10.0% HCl | RT | | 25.8 | 0.35 | |
| 19.0% HCl | RT | | 26.2 | 0.96 | |
| 28.0% HCl | RT | | 25.8 | 2.6 | |
| 0.5% $CH_3COOH$ | | 0.043 | 1800 | | No |

When the screw rotor 15 is made of the spheroidal graphite cast iron containing 28 to 30 wt % of nickel, its coefficient of thermal expansion becomes the same with that of the locking mechanism 17, therefore, there is no problem such that the timing gear 16 or 19 slips due to a slackness of the locking mechanism 17. However, it brings about no problem that the screw rotor 15 thermally expanded due to a rise in temperature during operation tightens the locking mechanism 17 a little, consequently, the nickel content of the spheroidal graphite cast iron is set 20 to 30 wt % in the present invention.

As to the screw rotor 15, the toothlike part 15*a* and the shaft 15*b* both made of the spheroidal graphite cast iron containing 20 to 30 wt % of nickel are casted integrally and the main casing 1 is made of the same material with that of the screw rotor 15. Therefore, the main casing 1 can pump corrosive gas. Even when the screw rotor 15 is heated up to 150 to 200° C., the locking mechanism 17 never becomes loose, therefore, the timing gear 16 or 19 never slips even if the timing gears 16 and 19 are not fixed by using keys through a time-consuming machining.

As to the locking mechanism 17, the timing gears 16 and 19 are easily fixed only by tightening the tightening member 21, moreover, the timing gears 16 and 19 are easily loosened only by loosening the tightening member 21, therefore, a gap adjustment between the timing gears 16 and 19 can be easily carried out.

With the construction described above, the dry vacuum pump according to the present invention has effects and advantages as follows:

(1) As to the screw rotor, since the shaft and the toothlike part are casted integrally, a labor to combine thereof is saved compared to a case that the shaft and the toothlike part are separately casted, resulting in the cost down.

In addition, with the above one body-structure, a diameter of the screw can be set the same with that of the shaft, therefore, a displacement volume of fluid per one revolution of the screw rotor can be enlarged.

(2) Since the screw rotor and the casino are made of the spheroidal graphite cast iron containing nickel, a resin coating is never needed even for a dry vacuum pump for use in steps of producing semiconductors during a hard process, therefore, a problem such that a degree of vacuum deteriorates due to peeling of a resin coating is solved.

(3) The nickel content of the spheroidal graphite cast iron containing nickel can be set an appropriate value so that a looseness of the locking mechanism never takes place, resulting in no slip for the timing gears.

Figure 4:
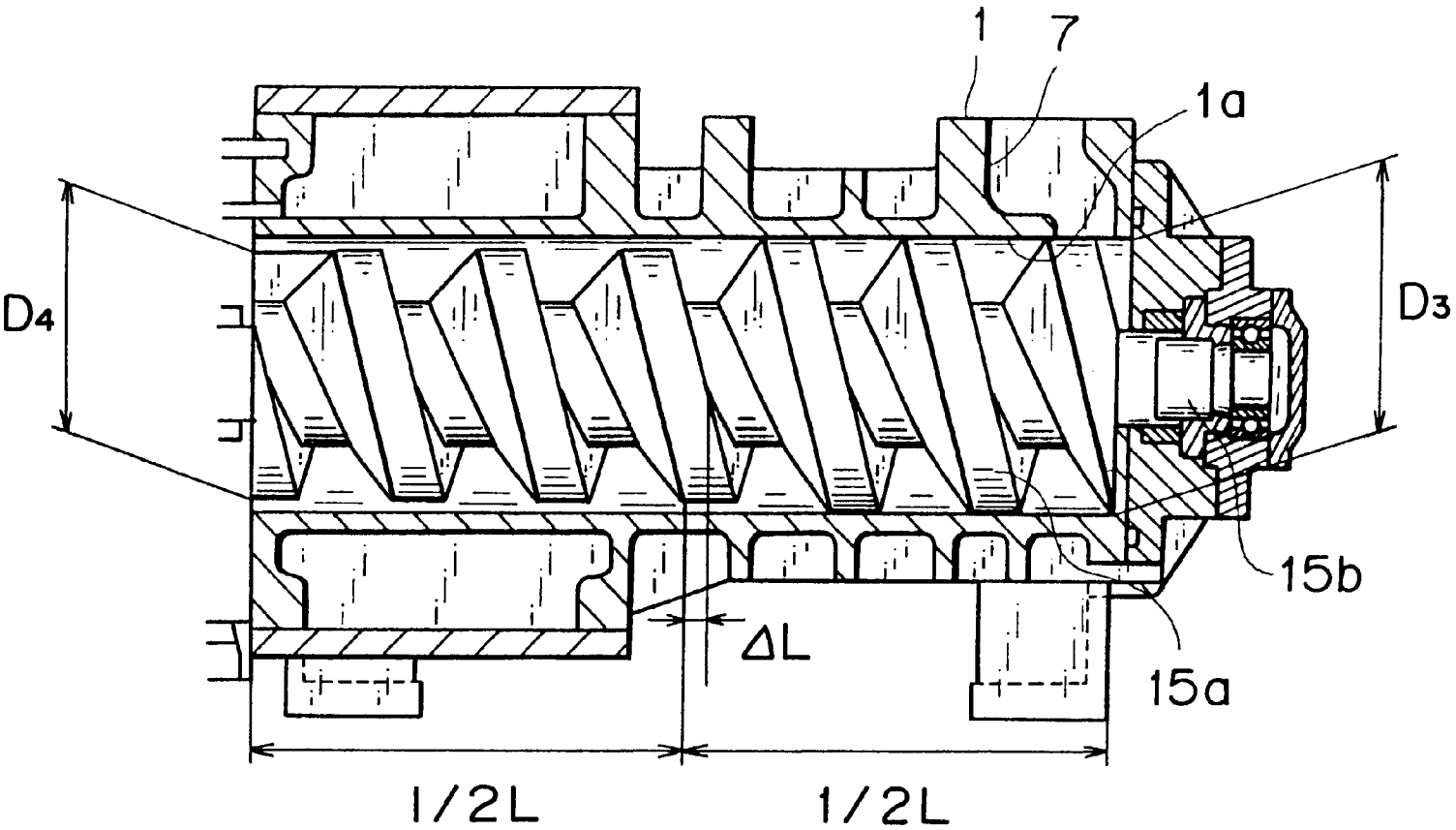
FIG. 4 is a longitudinal sectional view of a primary part illustrating the dimension of a screw-type dry vacuum pump of a first example according to a second aspect of the present invention.
Figure 7:
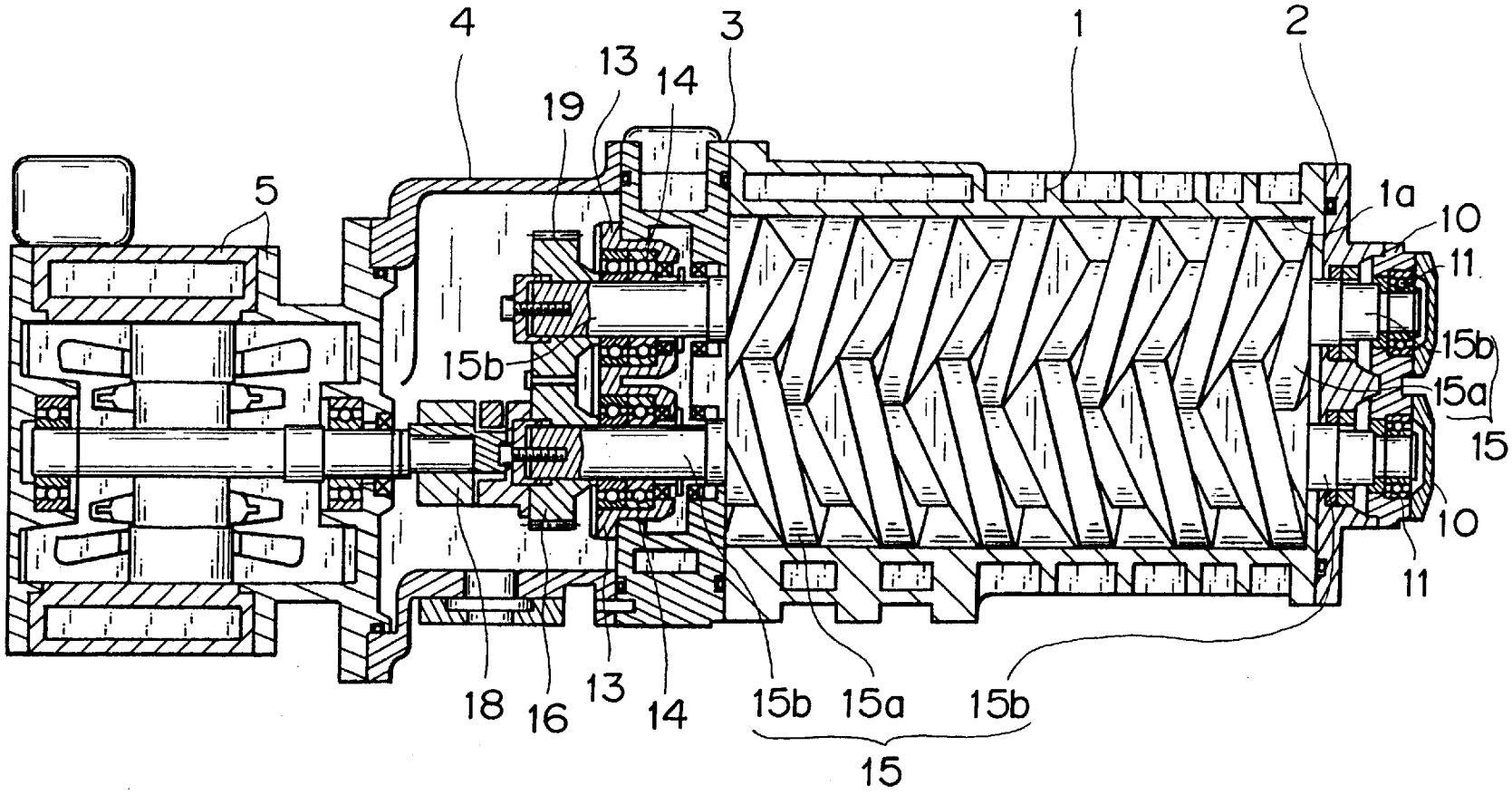
FIG. 7 PRIOR ART
FIG. 7 is a transverse sectional view of a dry vacuum pump.
Figure 8:
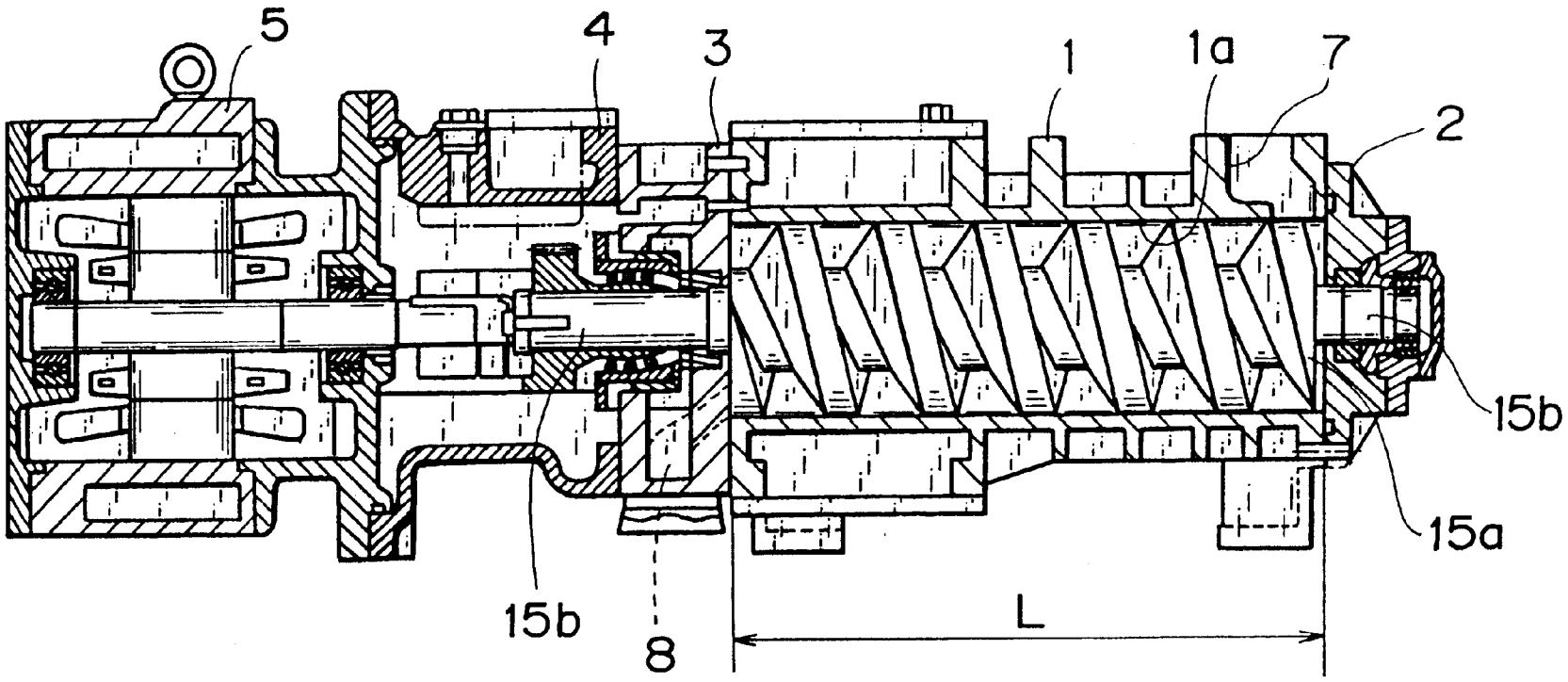
FIG. 8 PRIOR ART
FIG. 8 is a longitudinal sectional view of FIG. 7.
Figure 9:
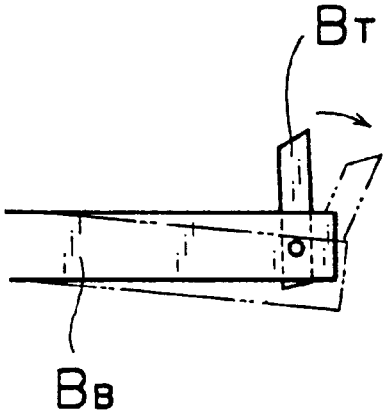
FIG. 9 PRIOR ART
FIG. 9 is a view illustrating a deflection of a boring bar.
Figure 10:
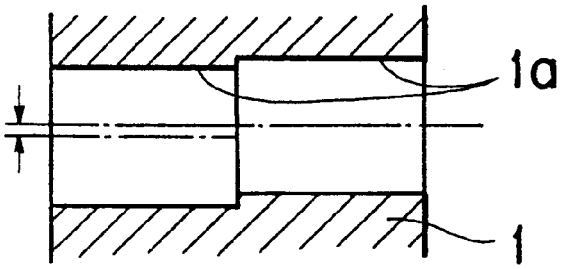
FIG. 10 PRIOR ART
FIG. 10 is a view illustrating a discrepancy between two centers of the machined inner surface when a boring is carried out from both sides of the main casing.

FIG. 4 is a longitudinal sectional view of a primary part illustrating the dimension of a screw-type dry vacuum pump of a first example according to the second aspect of the present invention. Since a structure of the pump is the same with that of a conventional pump shown in FIGS. 7 and 8, the same abbreviation numerals are given for the same parts of the conventional pump and their detailed explanation is omitted.

The main casing 1 and the screw rotors 15 are made of FCD containing nickel (FCDA-Ni system in JIS (Japanese Industrial Standard)).

The shape of the toothlike parts 15*a* is the same with that of conventional parts. The number of spiral leads is increased so as to make the number of locking chambers of fluid by the spirals plural, therefore, many spirals become sealing lines for shielding a leak even if a gap in a range from the vicinity of the center of the toothlike parts 15*a* toward the outlet side expands. Taking advantage of the above point, a tapered face of 1/(20L) is formed with respect to the toothlike part 15*a* so that an outer diameter of the toothlike part 15*a* is shortened from the center of the toothlike part 15*a* to the outlet side of the fluid (left side in FIG. 5). L is a length of the toothlike part 15*a*.

A Quimby curve is another name for an Epitrocoid curve. If a tooth formed by a Quimby curve, a circular arc and an Archimedean spiral curve is not a screw (i.e. a sprial), the tooth can smoothly rotate. On the other hand, if the tooth is a screw (i.e. a spiral), the portions of the Archimedean spiral curves interfere with each other, thereby the tooth cannot rotate. An Archimedean spiral curve is expressed by the equation $R=Rb+a\psi$, where 'a' is a constant.

Figure 14:
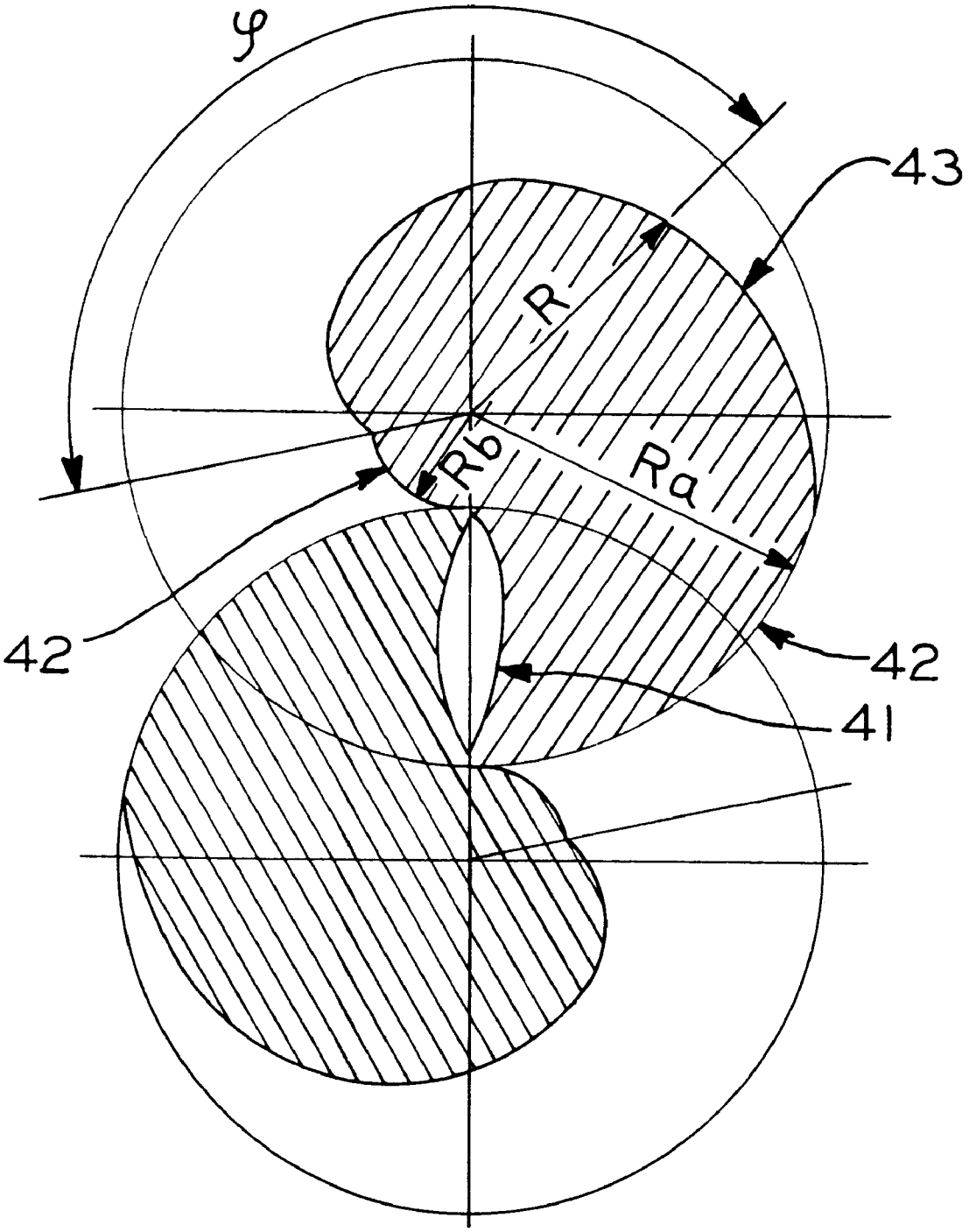
FIG. 14 is a cross sectional view of a spiral tooth part formed by a Quimby curve, a circular arc and a quasi-Archimedean spiral curve.

Referring to FIG. 14, the tooth cross section of the spiral toothlike part 15*a* according to the present invention is defined as a tooth cross section, which is formed by a Quimby curve 41, a circular arc 42 and a quasi-Archimedean spiral curve 43. A tooth cross section formed by such curves makes the tooth rotatable. That is, the portions of the Archimedean spiral curves interfering with each other are removed from the Archimedean spiral curves, then as a result, the quasi-Archimedean spiral curves 43 shown in FIG. 14 are formed instead.

FIG. 14 illustrated the cross section of the spiral toothlike part 15*a* when toothlike part 15*a* is cut perpendicularly to the shaft 15*b* of the screw rotor 15.

With the above construction, a diameter $D_3$ of the end of the inlet side of the toothlike part 15*a* has a clearance of 0.15 to 0.20 mm in diameter against the inner cylinder 1*a,* while a diameter $D_4$ of the end of the outlet side of the toothlike part 15*a* has a clearance of 0.35 to 0.40 mm in diameter against the inner cylinder 1*a*.

In addition, a ground finish-surface is formed with respect to the toothlike part 15*a* so that a diameter of the toothlike part 15*a* is shortened by 3/100 to 4/100 mm from a position, where is ΔL (in the present example, ΔL being about 10 mm) offset toward the inlet side from the center of the toothlike part 15*a,* to the outlet 7.

The ground finish-surface intersects at right angles with the tapered face mentioned above.

As to the dry vacuum pump thus constructed, although the thermal expansion of the outlet side of the toothlike part 15*a* is larger than that of the inlet side, since the tapered face that decreases in diameter from the center of the toothlike part 15*a* toward the outlet side of the fluid is formed, a clearance between the toothlike part 15*a* and the inner cylinder 1*a* during operation is kept nearly uniform and appropriate value for a full length of the toothlike part 15*a*.

Moreover, a problem such that the central portion of the inner cylinder 1*a* tends to be a little smaller in diameter is solved by the tapered face.

Figure 5:
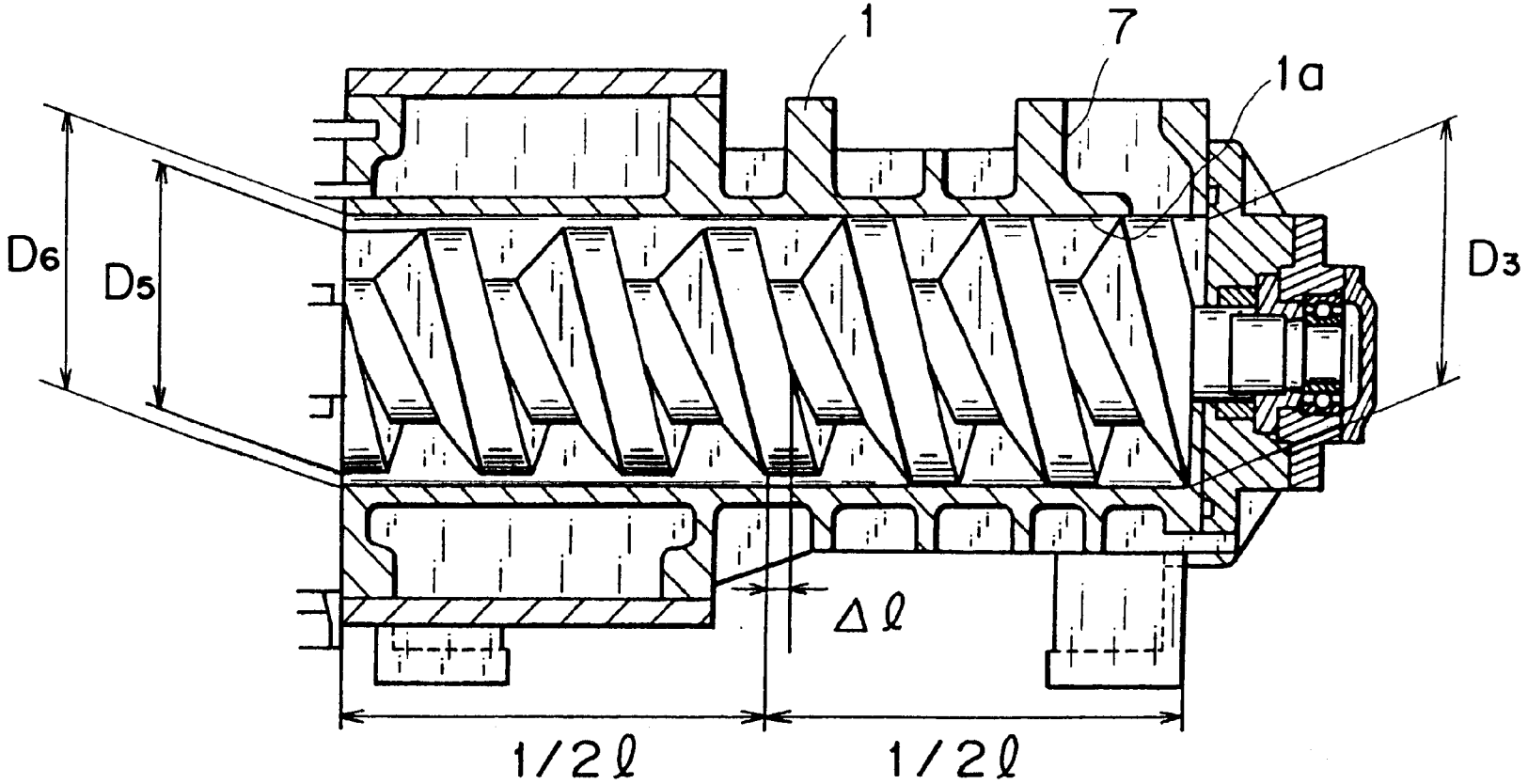
FIG. 5 is a longitudinal sectional view of a primary part illustrating the dimension of a screw-type dry vacuum pump of a second example according to the second aspect of the present invention.
Figure 6:
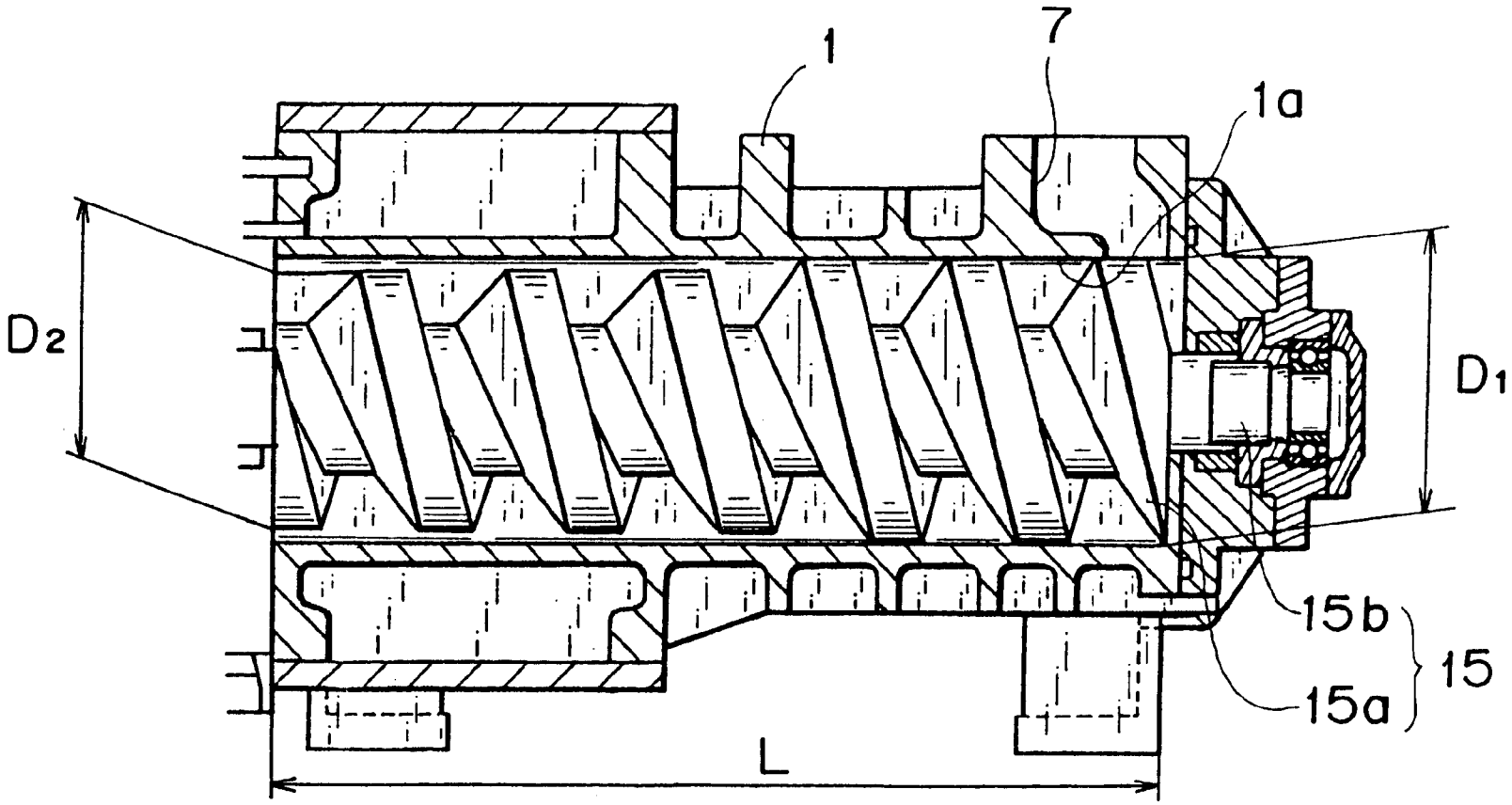
FIG. 6 PRIOR ART
FIG. 6 is a longitudinal sectional view illustrating the dimension of a conventional dry vacuum pump.

FIG. 5 is a longitudinal sectional view of a primary part illustrating the dimension of a screw-type dry vacuum pump of a second example according to the second aspect of the present invention. A, different point in comparison with the first example is that a machining for securing a clearance is performed not only for the toothlike parts 15*a* but also for the inner cylinder 1*a*.

As to this second example, a tapered face of 6/(100L) to 7/(100L) is formed with respect to the toothlike part so that an outer diameter of the toothlike part 15*a* is shortened from the center of the toothlike part 15*a* to the outlet side of the fluid. L is a length of the toothlike part 15*a*.

With this construction, a diameter $D_3$ of the end of the inlet side of the toothlike part 15*a* has a clearance of 0.15 to 0.20 mm in diameter. against the inner cylinder 1*a,* while a diameter $D_5$ of the end of the outlet side of the toothlike part 15*a* has a clearance of 0.30 to 0.35 mm in diameter against the inner cylinder 1*a*.

In addition, an enlarged (by 3/100 to 4/100 mm in diameter) internal diameter $D_6$ of the inner cylinder 1*a* is formed from a position, where is ΔL (in the present example, ΔL being about 10 mm) offset toward the inlet side from the center of the inner cylinder 1*a,* to the outlet side.

An effect or function of the enlarged internal diameter $D_6$ is the same with that of the diameter $D_4$ of the end of the outlet side of the toothlike part 15*a* and the ground finish-surface in the first example.

With the construction described above, the dry vacuum pump according to the present invention has effects and advantages as follows.

It has been expected that the screw rotor and the casing, which are exposed to hot and corrosive gas, are made of corrosion-resistant cast iron containing nickel when such a gas is pumped up by a dry vacuum pump. However, since the cast iron containing nickel is hard to be machined and the screw rotor and the casing have thermal strain due to their thermal expansion during the operation, a seizure phenomenon takes place, therfore, the cast iron containing nickel has not be employed. According to the present invention, since the machining of the screw rotor is performed allowing the outer diameter of the screw rotor to have a required dimensional accuracy, or since the. machining of the screw rotor and the casing is performed allowing the outer diameter of the screw rotor and the inner cylinder of the casing each to have a respective required dimensional accuracy, problems of hard machining of the casing and of seizure phenomenon during operation can be solved without deteriorating the pumping performance of the dry vacuum pump.

Figure 11:
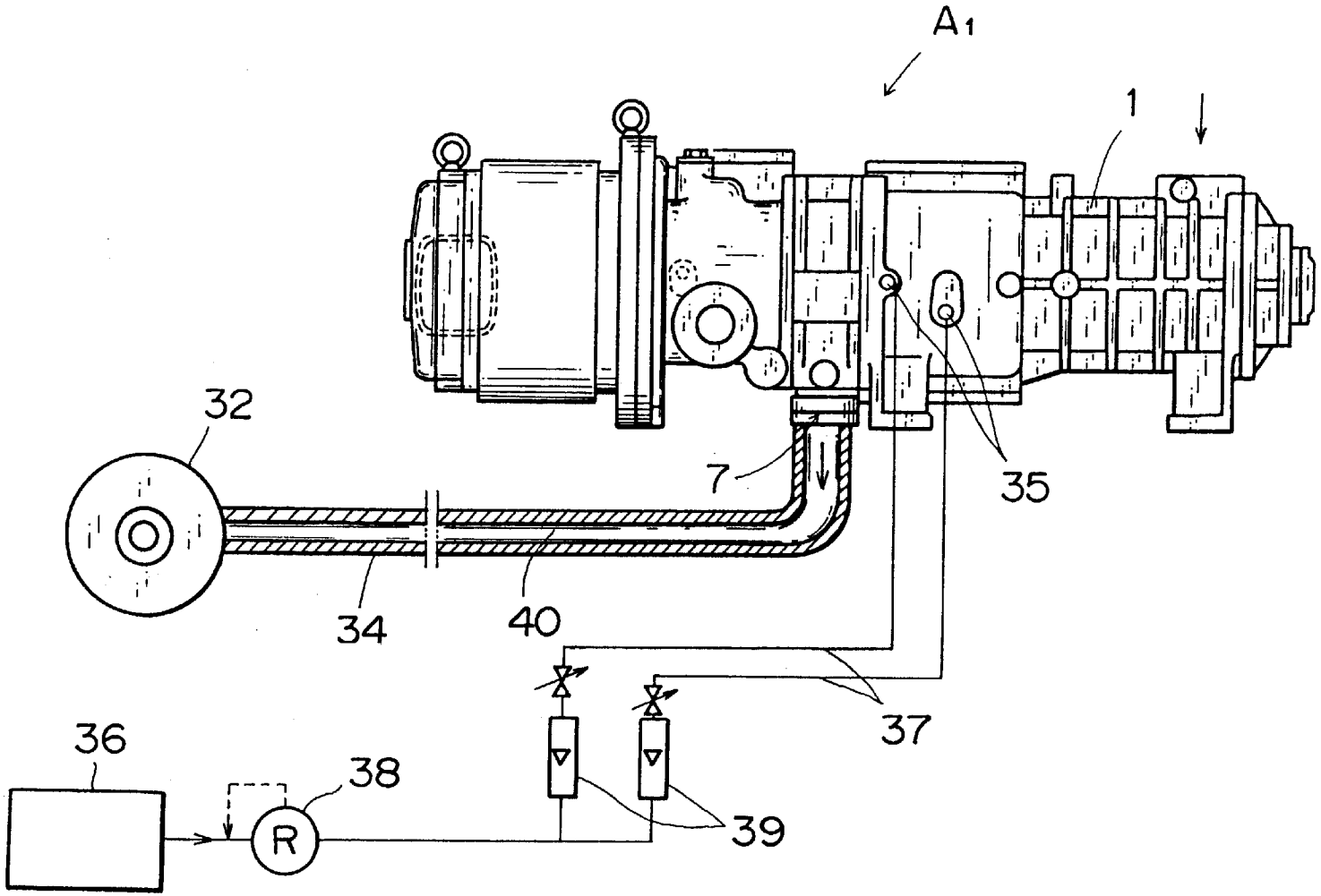
FIG. 11 is a partially ruptured plan view illustrating the whole of a dry vacuum pump for use in a hard process according to a third aspect of the present invention.

FIG. 11 is a partially ruptured plan view illustrating the whole of a dry vacuum pump $A_1$ for use in a hard process according to a third aspect of the present invention. A through hole 35 opening toward outside is formed on a closing chamber near the outlet 7 in the casing 1, a nitrogen-supplying pipe 37 that connects a nitrogen-supplier 36 disposed outside with the through hole 35 is provided, and a regulator 38 and a flow meter 39 are disposed on the nitrogen-supplying pipe 37.

Figure 12:
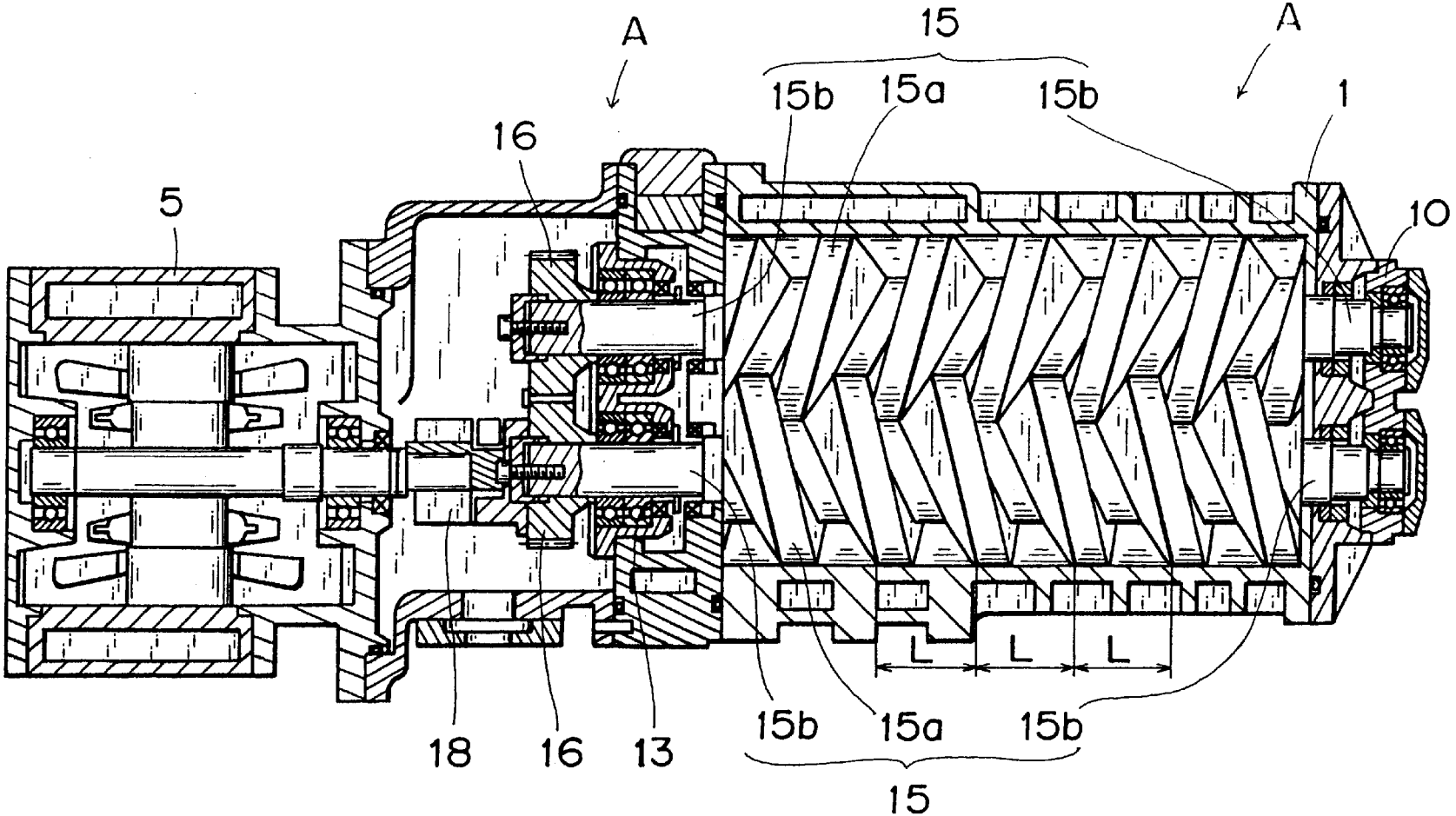
FIG. 12 is a transverse sectional view illustrating an inner structure of a screw rotor-type dry vacuum pump.
Figure 13:
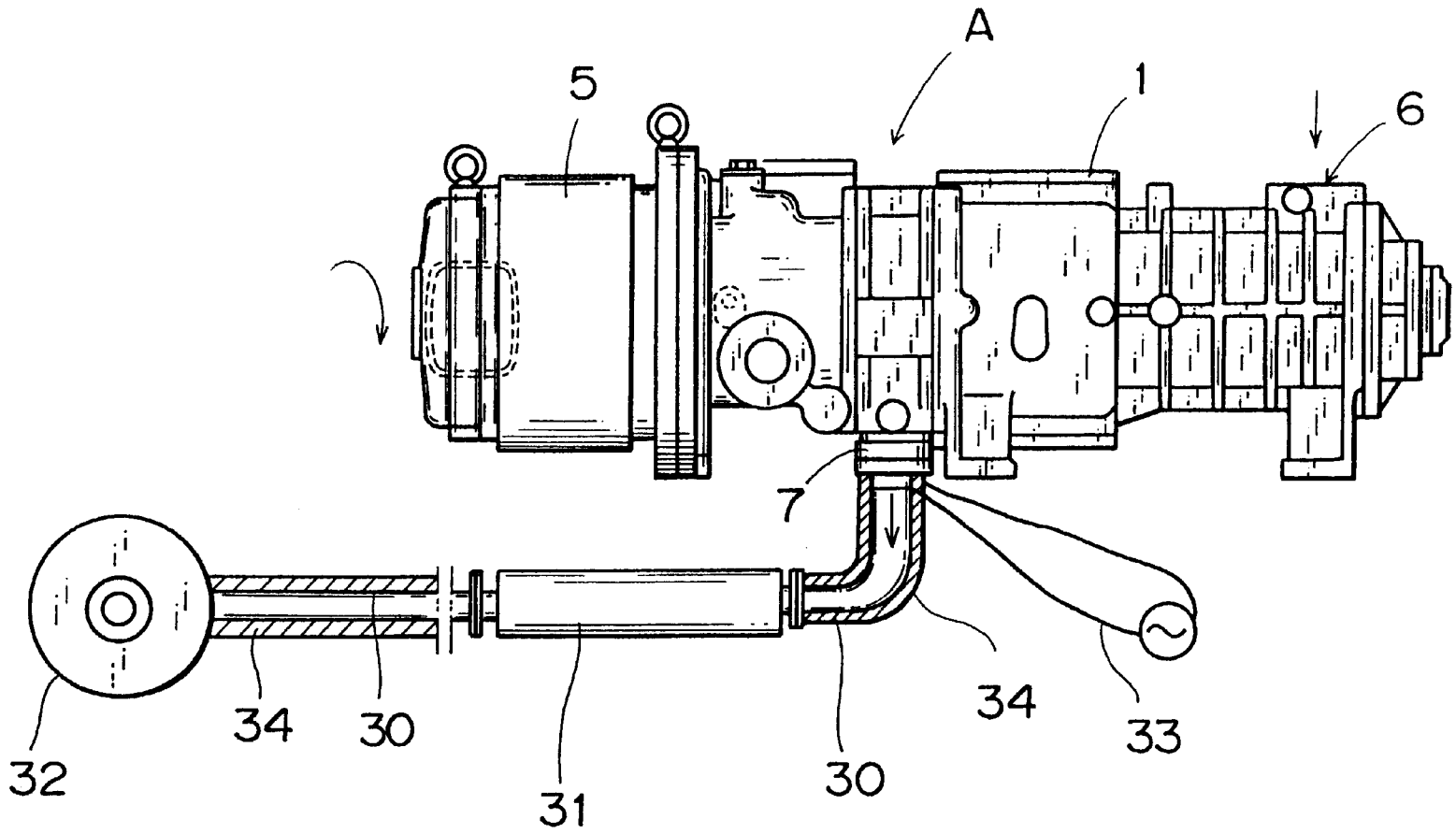
FIG. 13 PRIOR ART
FIG. 13 is a partially ruptured plan view illustrating the whole of a conventional dry vacuum pump for use in a hard process.

The number of screw leads L (see FIG. 12) of the toothlike parts 15*a* of the screw rotor 15 is set plural so that nitrogen gas is prevented from flowing backward into the inlet 6 when the nitrogen gas is fed into the closing chamber near the outlet 7, a process gas in the closing chamber is mixed with nitrogen gas so as to increase its heat capacity and transferred into an outlet path 40 (mentioned later) through the outlet 7.

As to the outlet path 40, one end thereof is connected to the outlet 7 and the opposite end thereof is connected to a scrubber (or trap) 32. The outlet path 40 is a straight pipe, in which a silencer is not provided, and is covered with a heat insulating material 34 on its outer surface, similarly to a conventional example.

Here, the straight pipe does not mean that there is no bent position for the pipe, but means that its inner surface has no convexo-concave portion all the way.

The scrubber 32 at an end of the outlet path 40 can be utilized also as a silencer.

As to the dry vacuum pump $A_1$ thus constructed, when a process gas pumped from the inlet 6 is kept in the closing chamber formed by the screw rotors 15 and approaches the outlet 7, the process gas is mixed with nitrogen gas fed from the nitrogen-supplying pipe 37 and its heat capacity increases.

Since the screw rotor 15 has a plurality of leads, the closing chamber near the outlet 7 does not communicate with the inlet 6, therefore, the mixed gas having a increased pressure never flows backward to the inlet 6.

The mixed gas transferred from the outlet 7 to the outlet path 40 has higher heat capacity than that of the process gas before the mixing and the outlet path 40 is a straight pipe having no convexo-concave portion in its inner surface, resulting in that an area of heat-transfer is decreased compared to a conventional pipe. Therefore, the mixed gas does not lose its temperature so much in the outlet path 40 and is discharged from the scrubber 32 with keeping its temperature higher than a sublimation temperature of products in the process gas.

Consequently, solidification and deposition of the products are prevented from occurring in the outlet path 40 without using any heater, a serious accident of a trip of the motor during operation is prevented from occurring and a worker is released from a time-consuming disassembly and cleaning of the outlet path 40 at frequent intervals.

With the construction described above, the dry vacuum pump according to the present invention has effects and advantages as follows:

(1) A conventional dry vacuum pump, which is for use in a hard process, has a problem such that a serious accident of a trip of the motor during operation takes place. While, as to the dry vacuum pump according to the present invention, the solidification and deposition of the products can be prevented from occurring in the outlet path by feeding nitrogen gas without using any heater, resulting in solving the above problem.

Since no heater is employed, the operation of the dry vacuum pump is free from a fire accident and an energy saving is attained thereby.

(2) Since a silencer that has been desposed on the outlet path is removed and a scrubber and the like is utilized also as a silencer, the solidification and deposition of the products are prevented from occurring in the outlet path, the problem of a time-consuming disassembly and cleaning of the outlet path is solved, and a cost of the dry vacuum pump is significantly reduced.

We claim:

1. A dry vacuum pump comprising:

a casing having an inner cylinder communicating with an inlet and an outlet of the pump;

a plurality of screw rotors, each of which comprises a shaft and spiral toothlike parts, received in the inner cylinder with the toothlike parts intermeshing with each other, said shaft is supported by the casing and said spiral toothlike part, a cross section of which is formed by a Quimby curve, a circular arc and a quasi-Archimedean spiral curve, is formed integrally on the shaft;

timing gears, each of which is attached to the respective shafts of the screw rotors, intermeshing with each other; and locking mechanisms, each of which is for fixing the timing gear to the shaft, wherein the screw rotor is made of spheroidal graphite cast iron containing nickel of 20 to 30% in weight and has substantially the same coefficient of thermal expansion with that of the locking mechanism made of mild steel.

2. The dry vacuum pump according to claim 1, wherein the locking mechanism comprises:

a locking member having an engaging portion for engaging to an outer peripheral surface of an end of the shaft and a pushing projection, an end of which abuts on the timing gear; and a tightening member for pressing the pushing projection onto the timing gear.

* * * * *

UNITED STATES PATENT AND TRADEMARK OFFICE

CERTIFICATE OF CORRECTION

PATENT NO. : 6,371,744 B1
DATED : April 16, 2002
INVENTOR(S) : Masaru Mito et al.

It is certified that error appears in the above-identified patent and that said Letters Patent is hereby corrected as shown below:

Title page,
Item [30], Foreign Application Priority Data, the filing date for Japanese Application No. 10-093220 should be changed from "April 19, 1998" to -- April 6, 1998 --

Signed and Sealed this

Eighth Day of October, 2002

*Attest:*

*Attesting Officer*

JAMES E. ROGAN
*Director of the United States Patent and Trademark Office*